United States Patent [19]

Miura

[11] Patent Number: 4,886,262

[45] Date of Patent: Dec. 12, 1989

[54] METHOD OF AND SYSTEM FOR TURNING OVER PAPERS IN A PAPER ARRANGING APPARATUS

[76] Inventor: Isamu Miura, 16-6 Ryuusen, 3-Chome, Taitoh-ku, Tokyo, Japan

[21] Appl. No.: 94,472

[22] Filed: Sep. 4, 1987

[30] Foreign Application Priority Data

Sep. 12, 1986 [JP] Japan ..... 61-215352

[51] Int. Cl.[4] ..... B65H 29/22

[52] U.S. Cl. ..... 271/186; 198/787; 414/757; 414/796.4

[58] Field of Search ..... 271/186, 902, 65; 414/796.4, 757; 198/787, 403, 402

[56] References Cited

U.S. PATENT DOCUMENTS 3,501,139 3/1970 Stobb ..... 271/186

3,917,256 11/1975 Kubasta ..... 271/186 X 4,052,128 10/1977 Burton ..... 271/65 X 4,118,024 10/1978 Gerhardt ..... 271/65 X 4,657,238 4/1987 Nishikawa ..... 271/186

*Primary Examiner*—Richard A. Schacher

*Attorney, Agent, or Firm*—Schwartz & Weinrieb

[57] ABSTRACT

In a paper arranging apparatus, a method and system for turning over papers while the papers are being transferred to a paper piling table from a paper feeding table by means of a crossing plate located between the two tables. A rotary shaft is disposed above the crossing plate, and the rear end of a stack of papers transferred onto the crossing plate from the paper feeding table is lifted and turned around the rotary shaft. The rotation of the rotary shaft conveys the stack of papers to the paper piling table.

10 Claims, 3 Drawing Sheets

METHOD OF AND SYSTEM FOR TURNING OVER PAPERS IN A PAPER ARRANGING APPARATUS

FIELD OF THE INVENTION

The present invention relates to a method of and a system for turning over papers in a paper arranging apparatus in which the papers stacked upon a paper feeding table are transferred to a paper piling table so as to arrange a particular corner of each paper sheet in order relative to one another.

BACKGROUND OF THE INVENTION

In the case of printing information upon paper by means of a printing machine, it is required that the supply of paper to the printing machine be made under identical conditions. And in the case of cutting paper of initially different dimensions to paper sheets having equal dimensions, it is required that at least two sides of each paper sheet be arranged in order. Such work is, however, usually done manually. Therefore, much labor and time are required. The efficiency of such process is extremely low and a uniform paper arrangement is also difficult to achieve.

The present applicant previously proposed an improved paper arranging apparatus which is capable of automatically and uniformly piling the paper sheets in a vertical stack under the conditions wherein the corner of the paper sheets are arranged in order. This apparatus is constructed in such a way that a stack of papers is transferred to a paper piling table from a paper feeding table located close to the paper piling table by means of a sliding plate positioned between the two tables, and is piled upon the paper piling table. This apparatus is successful in increasing the operational efficiency of the paper arranging process. In the case wherein it is required to turn over the papers, however, the papers must be transferred to the paper piling table by means of the sliding plate after an operator turns over the papers.

In order to achieve the above operation, an operator must manually lift the stack of papers disposed upon the paper feeding table and turn the papers over.

A large amount of labor is, therefore, required because the papers comprise a considerable amount of weight. And there exists the potential difficulties such as, for example, dropping of the papers during the turnover operation whereby the corners of the papers may become crushed and the papers may become crumpled.

Apparatus for turning over a vertical stack of papers before these papers are transferred to a paper piling table, or apparatus for turning over a vertical stack of papers already piled upon a paper piling table by means of a paper arranging apparatus, have of course already been used, however, such apparatus has been built upon a large scale basis. This apparatus is constructed so as to turn over an entire stack of papers by clamping and holding the top and bottom of the stack of papers and then lifting and turning the stack of papers. Such apparatus for turning over the papers is, however, large scale in size and very expensive. Extra work and time are also required for achieving the turning over operation.

SUMMARY OF THE INVENTION

The present invention has therefore been made in view of the foregoing problems. An object of the invention is to provide a method of turning over papers within a paper arranging apparatus by turning or coiling the rear end of the papers around a rotary shaft, and specifically to provide, in a method of transferring a stack of papers to a paper piling table from a paper feeding table by means of a crossing plate located between the two tables, the method of turning the papers over, while transferring the same, comprising rotating a rotary shaft in a direction opposite the paper transferring direction, the rotary shaft being positioned above and apart from the crossing plate and disposed transverse to the crossing plate, bringing the stack of papers onto the crossing plate from the paper feeding table by sliding the same thereon, lifting the rear end of the stack of papers and bringing the rear end of the stack of papers disposed upon the crossing plate near to the paper feeding table so that the rear end of the stack of papers can be turned or coiled around the rotary shaft, and piling the stack of turned and inverted papers onto the paper piling table as a result of the rotation of the rotary shaft.

Another object of the invention is to provide, in a paper arranging apparatus having a paper feeding table, a paper piling table, and a crossing plate located between the two tables, a system for turning over a stack of papers while the stack of papers is being transferred from the paper feeding table to the paper piling table by means of the crossing plate comprising a rotary shaft positioned above and apart from the crossing plate and disposed transverse to the crossing plate, and which rotates in the direction opposite the paper transferring direction.

In the above system, it is a preferred embodiment that the rotary shaft is supported at one end opposite the position at which an operator is located, and is formed so as to have a conical shape which is gradually tapered in its crosssectional diameter from the supported end toward the other end close to the operator.

In the operation of transferring the stack of papers to the paper piling table from the paper feeding table by means of the crossing plate by the use of the aforenoted system, at first, an operator brings a stack of paper onto the crossing plate from the paper feeding table by means of a sliding operation (the rotary shaft is positioned above the stack of papers). Then, the operator lifts the rear end of the stack of papers and guides the rear end of the stack of papers upon the crossing plate by turning the rear end of the stack of papers around the rotary shaft. By means of the above operation and the rotation of the rotary shaft, the stack of papers is turned over and transferred so as to slide upon the crossing plate toward the paper piling table.

According to the system, the work an operator needs to perform is only to lift the rear end of the stack of papers and to wind the same around the rotary shaft. The wound papers automatically turn around the rotary shaft and move upon the crossing plate so as to slide toward the paper piling table as a result of the rotation of the rotary shaft.

An operator is not, therefore, required to lift all of the papers as was previously done.

BRIEF DESCRIPTION OF THE DRAWINGS

Various other objects, features, and attendant advantages of the present invention will become more fully appreciated from the following detailed description, when considered in conjunction with the accompanying drawings, in which like reference characters designate like or corresponding parts throughout the several views, and wherein.

DESCRIPTION OF THE PREFERRED EMBODIMENT

An embodiment of the method of and the system for turning over a stack of paper in a paper arranging apparatus of the present invention will now be described.

Figure 1:
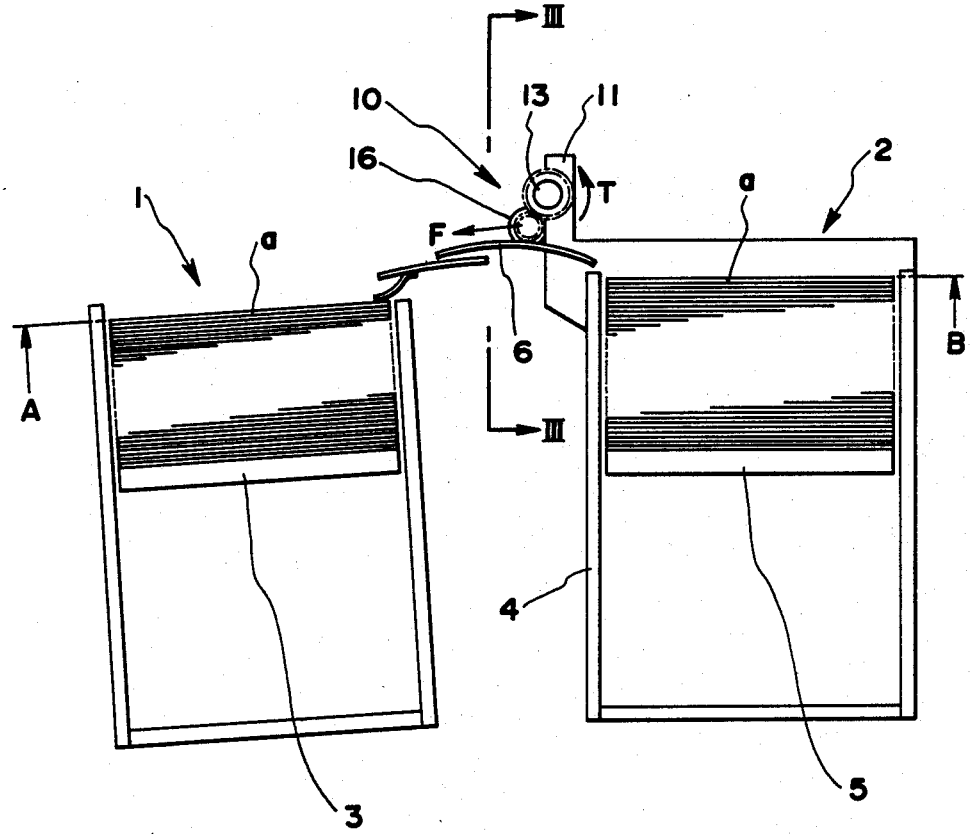
FIG. 1 is a front view of the system for turning over papers in a paper arranging apparatus constructed in accordance with an embodiment of the invention.

Referring to FIG. 1, the reference numeral 1 designates a paper piling table located adjacent to a paper feeding table 2. In accordance with the paper arranging operation, the table 1 is constructed so as to be tilted by means of a tilting mechanism (not shown in the drawings) so that the corner portion of the inmost side of the table 1 remote from the paper feeding table 2 can be disposed at the lowest position, and the table 1 is also constructed so as to gradually lower a support table 3 so as to maintain the upper surface of a vertical stack of piled papers at a predetermined piling level A. The paper feeding table 2 is similarly provided with a support table 5 for papers a which is automatically movable upwardly and downwardly along a side frame 4 so as to maintain the upper surface of the papers stacked upon the support table 4 at a predetermined level B.

Figure 2:
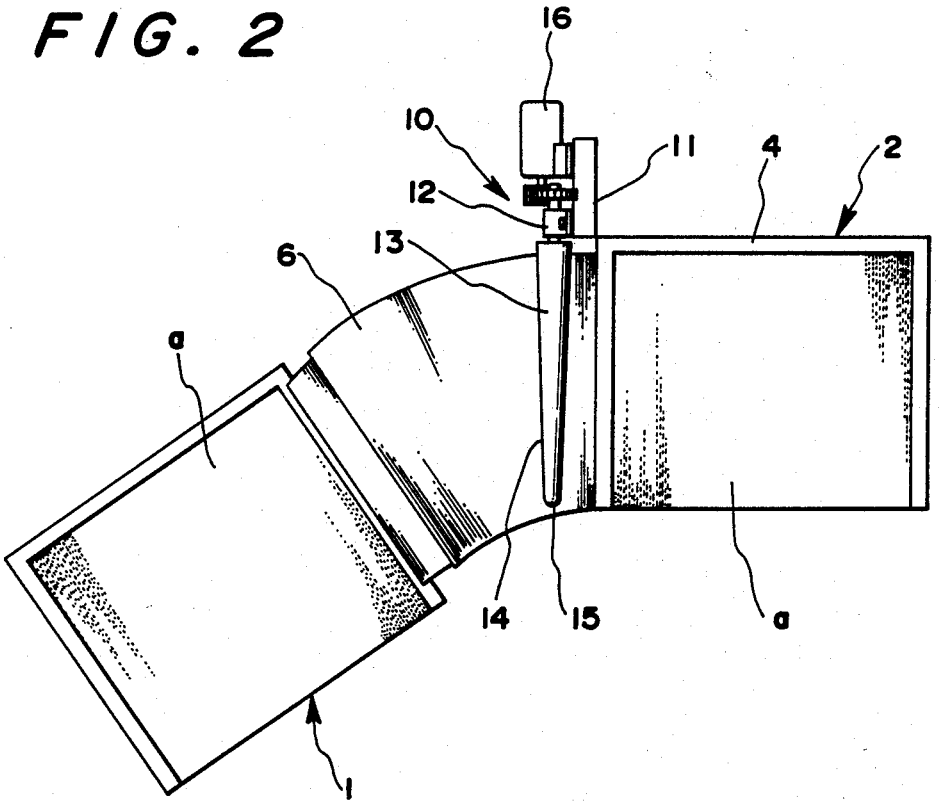
FIG. 2 is a plan view of the system shown in FIGURE 1.
Figure 3:
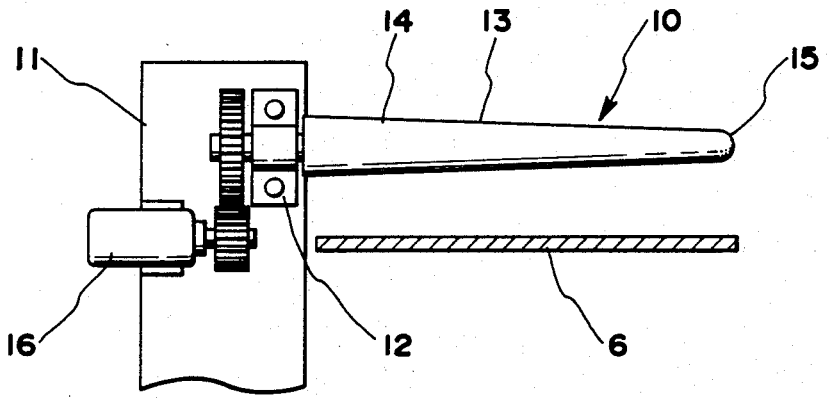
FIG. 3 is a cross-sectional view taken along the line III—III of FIG. 1.

The numeral 6 designates a crossing plate located between the paper piling table 1 and the paper feeding table 2, and the crossing plate forms an arcuately-shaped smooth paper transferring surface between the paper piling table 1 and the paper feeding table 2, the tables 1 and 2 being located in side by side relation as shown in FIG. 2. The crossing plate 6 is also positioned at a height suitable to transfer the papers a by sliding the same at the level A of the paper piling table 1 from the level B of the paper feeding table 2.

The mechanism 10 of the present invention for turning over or inverting the papers disposed upon the crossing plate 6 is disposed above the crossing plate 6. The mechanism 10 comprises a rotary shaft 13 which is rotatably supported at one end thereof by means of a bearing member 12 fixed upon a support frame 11 projecting outwardly from the side frame 4 of the paper feeding table 2, and is disposed transversely to the paper transferring path of the crossing plate 6. The rotary shaft 13 is formed as a conically shaped roll 14 which becomes gradually smaller in diameter from the supported end toward the other distal end. The distal end 15 of the rotary shaft 13 is hemispherically shaped. The rotary shaft 13 is also positioned at a distance of 10–20 cm above and apart from the crossing plate 6, and is rotated in the direction opposite to the paper transferring direction (see arrow mark F) by means of a motor 16 fixed upon the support frame 11. Namely, the rotation of the rotary shaft 13 is made in the direction shown by the arrow mark T.

In the operation of transferring the papers a from the paper feeding table 2 and piling the same upon the paper piling table 1 by means of a conventional method, an operator transfers the stack of papers a onto the crossing plate 6 from the level B of the paper feeding table 2 (the stack of papers a passes under the rotary shaft 13), and then the operator brings the stack of papers to the level A of the paper piling table 1 by sliding the same across or upon the crossing plate 6. The piling of the papers can be made by repeating the above operation.

In the operation of turning over the papers and piling the overturned or inverted papers upon the paper piling table 1, the work is made on the condition that the rotary shaft 13 is rotated by means of the motor 16.

Figure 4:
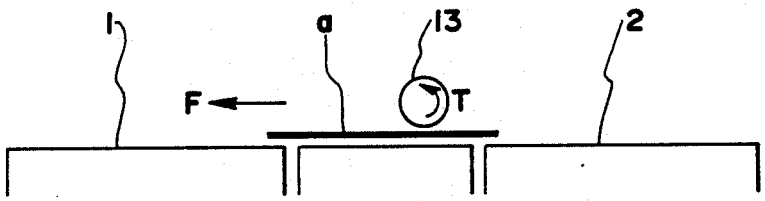
FIGS. 4(*a*), (*b*), and (*c*) are schematic illustrations of the method of turning over papers in the paper arranging apparatus.
Figure 4:
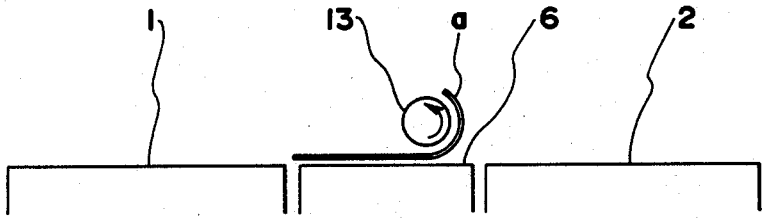
Figure 4:
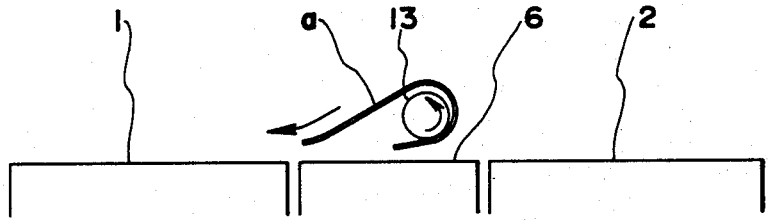

As shown in FIG. 4, at first an operator transfers the stack of papers a onto the crossing plate 6 from the level B of the paper feeding table 2 (the stack of papers a passes under the rotary shaft 13), and brings the leading or front end of the papers a to a position such that the rear end of the papers a does not pass the rotary shaft 13. (FIG. 4(*a*)). Then, the operator lifts the rear end of the papers a and guides the rear end of the papers a upon the crossing plate which is disposed within the vicinity of the paper feeding table 2 so as to be turned or coiled around the rotary shaft 13. (FIG. 4(*b*), FIG. 4(*c*)). The stack of papers a is then turned over. The rotation of the rotary shaft 13 moves the turned papers a toward the paper piling table 1 by sliding the same upon the crossing plate 6, and brings the turned papers a to the level A of the paper piling table 1. (FIG. 4(*c*)). The turning and piling of a complete stack of papers can be made by repeating the above operation.

According to the preferred embodiment of the invention wherein the rotary shaft 13 comprises the conically shaped roll 14 which is gradually tapered in cross-sectional diameter from one end thereof to the other end thereof, the stack of papers a turned around the rotary shaft 13 changes it original transferring direction upon the crossing plate 6, and the turned papers come toward the front of the paper piling table 2. Therefore, the arrangement of the papers upon the paper piling table 2 can be readily achieved.

As mentioned above, the method of and the system for turning over papers in the paper arranging apparatus provided in accordance with the invention is characterized by the existence of the rotary shaft disposed above the crossing plate. A stack of papers can be turned over by means of a simplified operation during transfer of the papers to the paper piling table from the paper feeding table, and can be piled without crumpling and crushing of the papers. The apparatus for the invention is simple and the cost of the apparatus is low.

Obviously, many modifications and variations of the present invention are possible in light of the above teachings. It is therefore to be understood that within the scope of the appended claims, the present invention may be practiced otherwise than as specifically described herein.

I claim:

1. Paper arranging apparatus for turning over or inverting a pack of papers to be transferred by means of an operator from a paper feeding table to a paper piling table in a predetermined paper transferring direction along a predetermined paper flow path, comprising:

a paper feeding table having a longitudinal axis extending in a first predetermined direction along said predetermined paper flow path;

a paper piling table having a longitudinal axis extending in a second predetermined direction along said predetermined paper flow path which is disposed at a predetermined angle with respect to said first predetermined direction of said paper feeding table;

crossing plate means, interposed between said paper feeding table and said paper piling table so as to define an operator station between said paper feeding table and said paper piling table whereby said pack of papers can be transferred by said operator from said paper feeding table to said paper piling table, and having a substantially arcuate configuration, within a substantially horizontal plane, as defined by a longer edge portion and a shorter edge portion, such that a portion of said predetermined paper flow path, defined upon said crossing plate means, is substantially curvilinear; and rotary shaft means, having a tapered cross-section as viewed along an axial plane thereof such that the cross-sectional diametrical extent thereof gradually decreases from one end thereof to the other end thereof with the larger diameter portion thereof disposed within the vicinity of the longer edge portion of said crossing plate while the smaller diameter portion thereof is disposed within the vicinity of said shorter edge portion of said crossing plate, disposed above said crossing plate in a direction transverse to said predetermined paper flow path and rotating in a direction opposite to said predetermined paper transferring direction, for receiving a trailing edge portion of said pack of papers, disposed upon said crossing plate, to be coiled about said rotary shaft means by said operator disposed at said operator station in a direction corresponding to said rotating direction of said rotary shaft means so as to invert said pack of papers about said rotary shaft means and to feed said inverted pack of papers along said curvilinear flow path portion of said predetermined paper flow path toward said paper piling table.

2. Apparatus as set forth in claim 1, wherein:

said rotary shaft means is supported in a cantilevered manner upon said paper feeding table.

3. Apparatus as set forth in claim 2, wherein:

said larger diameter portion of said rotary shaft means is fixedly supported upon said paper feeding table.

4. Apparatus as set forth in claim 2, wherein:

said rotary shaft means is disposed above an upstream portion of said crossing plate means within the vicinity of said paper feeding table.

5. Apparatus as set forth in claim 2, wherein:

said smaller diameter portion of said rotary shaft means comprises a free, non-supported end portion of said rotary shaft means.

6. Apparatus as set forth in claim 2, further comprising:

motor means mounted upon said paper feeding table for rotatably driving said rotary shaft means; and gear means interconnecting said motor means and said rotary shaft means for transmitting said rotary drive of said motor means to said rotary shaft means.

7. Apparatus as set forth in claim 6, wherein:

said larger diameter portion of said rotary shaft means is operatively engaged with said gear means.

8. Apparatus as set forth in claim 1, further comprising:

vertically movable support means disposed within said paper feeding table for maintaining the upper surface of a stack of paper disposed upon said paper feeding table at a predetermined level relative to said crossing plate.

9. Apparatus as set forth in claim 1, further comprising:

vertically movable support means disposed within said paper piling table for maintaining the upper surface of a stack of paper disposed upon said paper piling table at a predetermined level relative to said crossing plate.

10. Apparatus as set forth in claim 1, wherein:

said crossing plate has an arcuate configuration as viewed in a vertical cross-sectional plane.

* * * * *